US008963786B2

(12) United States Patent
Kowalewicz et al.

(10) Patent No.: US 8,963,786 B2
(45) Date of Patent: Feb. 24, 2015

(54) ANTENNA MAST ASSEMBLIES

(75) Inventors: John V. Kowalewicz, Ortonville, MI (US); Ayman Duzdar, Grand Blanc, MI (US); Zhigao Chen, Kunsahn (CN); Hasan Yasin, Grand Blanc, MI (US); Liangguo Song, Nanchong (CN); Gary Keith Reed, Grand Blanc, MI (US); Ankit Ramnik Gogri, Grand Blanc, MI (US)

(73) Assignee: Laird Technologies, Inc., Earth City, MO (US)

( * ) Notice: Subject to any disclaimer, the term of this patent is extended or adjusted under 35 U.S.C. 154(b) by 357 days.

(21) Appl. No.: 13/546,174

(22) Filed: Jul. 11, 2012

(65) Prior Publication Data

US 2014/0015717 A1 Jan. 16, 2014

(51) Int. Cl.

*H01Q 1/32* (2006.01)
*H01Q 1/36* (2006.01)
*H01Q 5/00* (2006.01)

(52) U.S. Cl.

CPC ..... *H01Q 1/3275* (2013.01); *H01Q 5/0027* (2013.01)
USPC ..... 343/713; 343/895

(58) Field of Classification Search

CPC ... H01Q 1/3275; H01Q 1/362; H01Q 5/0027; H01Q 11/08
USPC ..... 343/711, 713, 715, 866, 867, 891, 895
See application file for complete search history.

(56) References Cited

U.S. PATENT DOCUMENTS

| | | | | |
|---|---|---|---|---|
| 6,930,643 | B2 | 8/2005 | Byrne et al. | |
| 7,671,812 | B1 | 3/2010 | Yasin et al. | |
| 2011/0050519 | A1* | 3/2011 | Oki et al. | 343/713 |
| 2012/0081253 | A1 | 4/2012 | Duzdar et al. | |

FOREIGN PATENT DOCUMENTS

| | | |
|---|---|---|
| DE | 19941501 | 6/2001 |
| EP | 1528624 | 5/2005 |
| EP | 1672734 | 6/2006 |
| EP | 1926175 | 5/2008 |

(Continued)

OTHER PUBLICATIONS

U.S. Appl. No. 61/570,534, filed Dec. 14, 2011, Thiam et al.

(Continued)

*Primary Examiner* — Robert Karacsony
(74) *Attorney, Agent, or Firm* — Harness, Dickey & Pierce, P.L.C.

(57) ABSTRACT

Exemplary embodiments are disclosed of antenna mast assemblies, which may be configured for multiband operation for automobiles or other vehicular applications. In an exemplary embodiment, an antenna mast assembly generally includes a coil radiator including a first coil portion and a second coil portion. The antenna mast assembly also includes a support having a first end portion, a second end portion, a first protruding portion, and a second protruding portion. The coil radiator is disposed about at least a portion of the support such that the first coil portion is between the first protruding portion and the first end portion of the support, and such that the second coil portion is between the second protruding portion and the second end portion of the support.

24 Claims, 9 Drawing Sheets

(56) References Cited

FOREIGN PATENT DOCUMENTS

| | | |
|---|---|---|
| GB | 2400497 | 10/2004 |
| WO | WO2012/044968 | 4/2012 |

OTHER PUBLICATIONS

European Search Report dated Aug. 13, 2013 from European counterpart application No. EP13173829.6; 6 pages which claims priority to the instant application.

* cited by examiner

ANTENNA MAST ASSEMBLIES

FIELD

The present disclosure relates to antenna mast assemblies, which may be configured for multiband operation for automobiles or other vehicular applications.

BACKGROUND

This section provides background information related to the present disclosure which is not necessarily prior art.

A multiband antenna assembly typically includes multiple antennas to cover and operate at multiple frequency ranges. A printed circuit board (PCB) having radiating antenna elements is a typical component of the multiband antenna assembly. Another typical component of the multiband antenna assembly is an external antenna, such as a vertically extending whip antenna rod or mast. The multiband antenna assembly may be installed or mounted on a vehicle surface, such as the roof, trunk, or hood of the vehicle. The antenna may be connected (e.g., via a coaxial cable, etc.) to one or more electronic devices (e.g., a radio receiver, a touchscreen display, GPS navigation device, cellular phone, etc.) inside the passenger compartment of the vehicle, such that the multiband antenna assembly is operable for transmitting and/or receiving signals to/from the electronic device(s) inside the vehicle.

SUMMARY

This section provides a general summary of the disclosure, and is not a comprehensive disclosure of its full scope or all of its features.

Exemplary embodiments are disclosed of antenna mast assemblies, which may be configured for multiband operation for automobiles or other vehicular applications. In an exemplary embodiment, an antenna mast assembly generally includes a coil radiator including a first coil portion and a second coil portion. The antenna mast assembly also includes a support having a first end portion, a second end portion, a first protruding portion, and a second protruding portion. The coil radiator is disposed about at least a portion of the support such that the first coil portion is between the first protruding portion and the first end portion of the support, and such that the second coil portion is between the second protruding portion and the second end portion of the support.

Another exemplary embodiment includes an antenna mast assembly for use with an automobile. In this example, the antenna mast assembly generally includes a coil radiator having a first coil portion, a second coil portion, and a linear portion extending between and connecting the first and second coil portions. The first coil portion has a different configuration than the second coil portion such that the first coil portion is operable over or resonant in one or more frequency bands different than the second coil portion. The coil radiator is operable over or resonant in multiple frequency bands including an amplitude modulation (AM) band, a frequency modulation (FM) band, and one or more cellular frequency bands.

A further exemplary embodiment includes an antenna mast assembly for use with an automobile. In this example, the antenna mast assembly generally includes a flexible rod and a coil radiator disposed about at least a portion of the flexible rod. The flexible rod comprises fiberglass with epoxy resin, polyamide, and/or polyester.

Further areas of applicability will become apparent from the description provided herein. The description and specific examples in this summary are intended for purposes of illustration only and are not intended to limit the scope of the present disclosure.

DRAWINGS

The drawings described herein are for illustrative purposes only of selected embodiments and not all possible implementations, and are not intended to limit the scope of the present disclosure.

DETAILED DESCRIPTION

Example embodiments will now be described more fully with reference to the accompanying drawings.

The inventors' hereof have recognized that while some conventional antenna mast assemblies are useful in providing AM, FM, and cellular multiband operation for automobiles or other vehicular applications, they have a large part count such that numerous components have to be produced and assembled together (e.g., more than 10 different components, etc.). With such a large part count, the inventors have recognized that the production process tends to be relatively complex with relatively high material and labor costs, and a high scrap rate. Plus, it can be difficult to control product quality of so many parts.

Figure 1A:
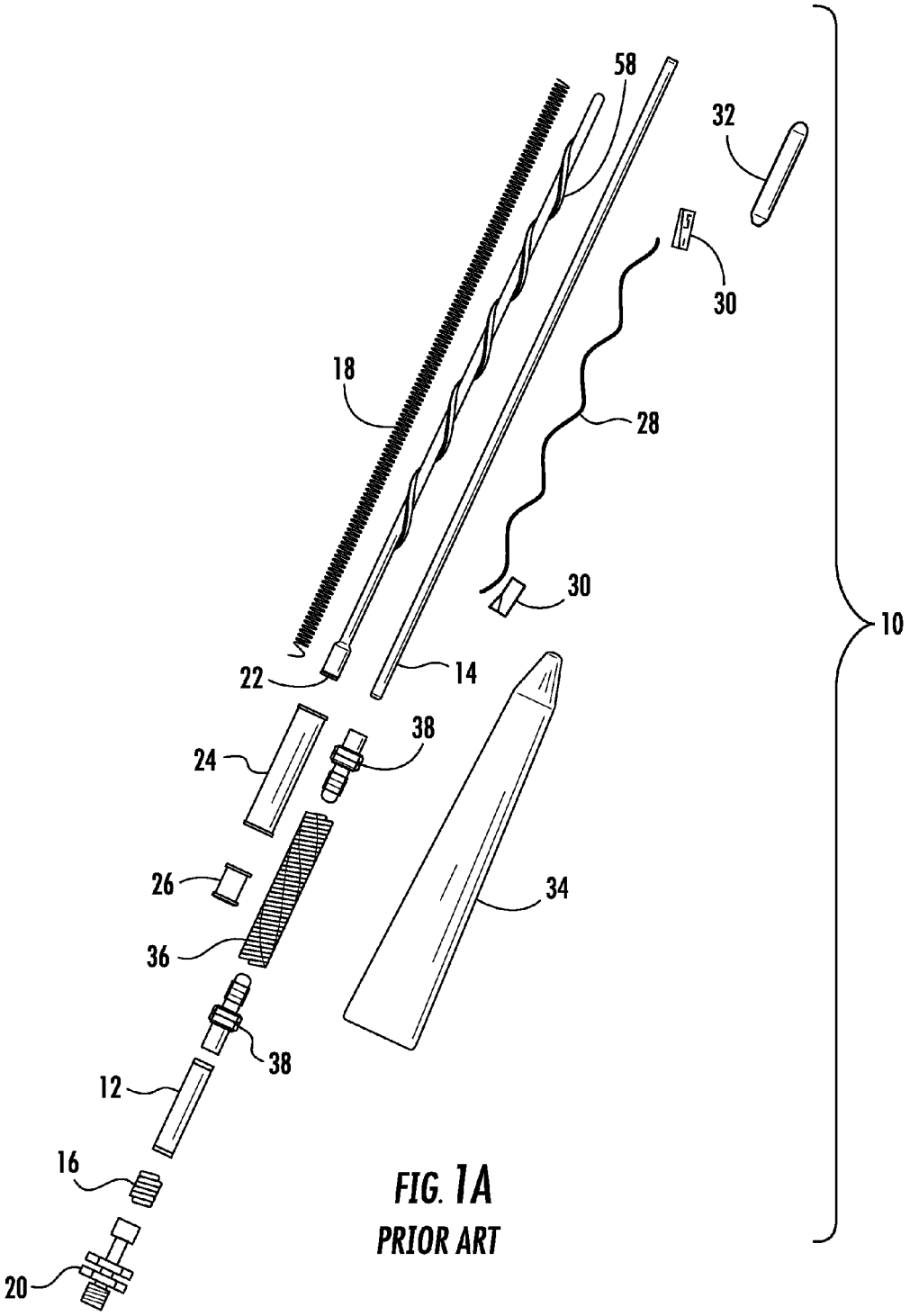
FIG. 1A PRIOR ART
FIG. 1A is an exploded perspective view of a conventional antenna mast assembly.

FIG. 1A illustrates a conventional antenna mast assembly 10 having two separated shafts or rods 12, 14 and two separated coil or helical radiators 16, 18 for covering the AM, FM, and cellular frequency bands. The antenna mast assembly 10 also includes numerous other components or parts including the connector 20 and three separate upper, middle, lower shrink tubes 22, 24, 26 for covering the rods 12, 14, and radiating elements 16, 18. The tube 22 comprises a heat-shrinkable or heat-shrink tube that is positioned over the rod 14 and spiral straking 28, which is attached to the rod 14 via adhesive tape 30. Heat is applied to shrink the tube 22 about the rod 14, helical radiator 18, and straking 28, to thereby couple the tube 22 with the rod 14, helical radiator 18, and straking 28. The tube 22 includes a spiral element 58 (e.g., raised straking, etc.) formed as a result of shrinking the tube 22 over the straking 28. A cap 32 and base 34 are respectively located at the top and bottom of the antenna mast assembly 10 with the tube 22 extending therebetween. Also shown in FIG. 1A, the antenna mast assembly 10 includes a shock spring 36 and ferrules 38 for coupling the rods 12, 14 to the spring 36. The overmold or base 34 is disposed over the rod 12, coil 16, shock spring 36, and ferrules 38.

Accordingly, the conventional antenna mast assembly 10 illustrated in FIG. 1A includes numerous components and has a relatively high part count. After recognizing these drawbacks, the inventors hereof have developed and disclose herein exemplary embodiments of antenna mast assemblies having integrated components (e.g., a combined coil or helical radiator operable in AM, FM, and cellular frequency bands, etc.) and/or a rod operable as support, support structure, or mount for the coil radiator. The rod may have step features (e.g., protruding portions, steps, shoulders, etc.) configured to support and hold in place the coil or helical radiator. This may also allow for reduced part counts (e.g., a single combined AM/FM/CELL coil instead of two separate coils, etc.), reduced labor costs, reduced overall manufacturing costs, and/or shorter mast lengths.

The rod having the step features may also allow the coil or helical radiator to be wound about the rod by a machine in an automated process, which may thus allow for reduced labor and assembly costs. For example, the upper and lower coil portions of the coil radiator are connected by a straight wire portion (broadly, linear or straight portion) extending between the upper and lower coil portions. A winding machine may draw wire or other portion tightly about the rod during the winding of the coil radiator about the rod. Without the step features to stop the coils from slidably moving along the rod and to maintain the straight wire portion in position, the coils of upper and/or lower coil portions may loosen during or after winding with the winding machine. Thus, the step features help solve the coil loosening issue and provide the feasibility to wind the coil radiator about the rod in an automated process with a machine.

Figure 1B:
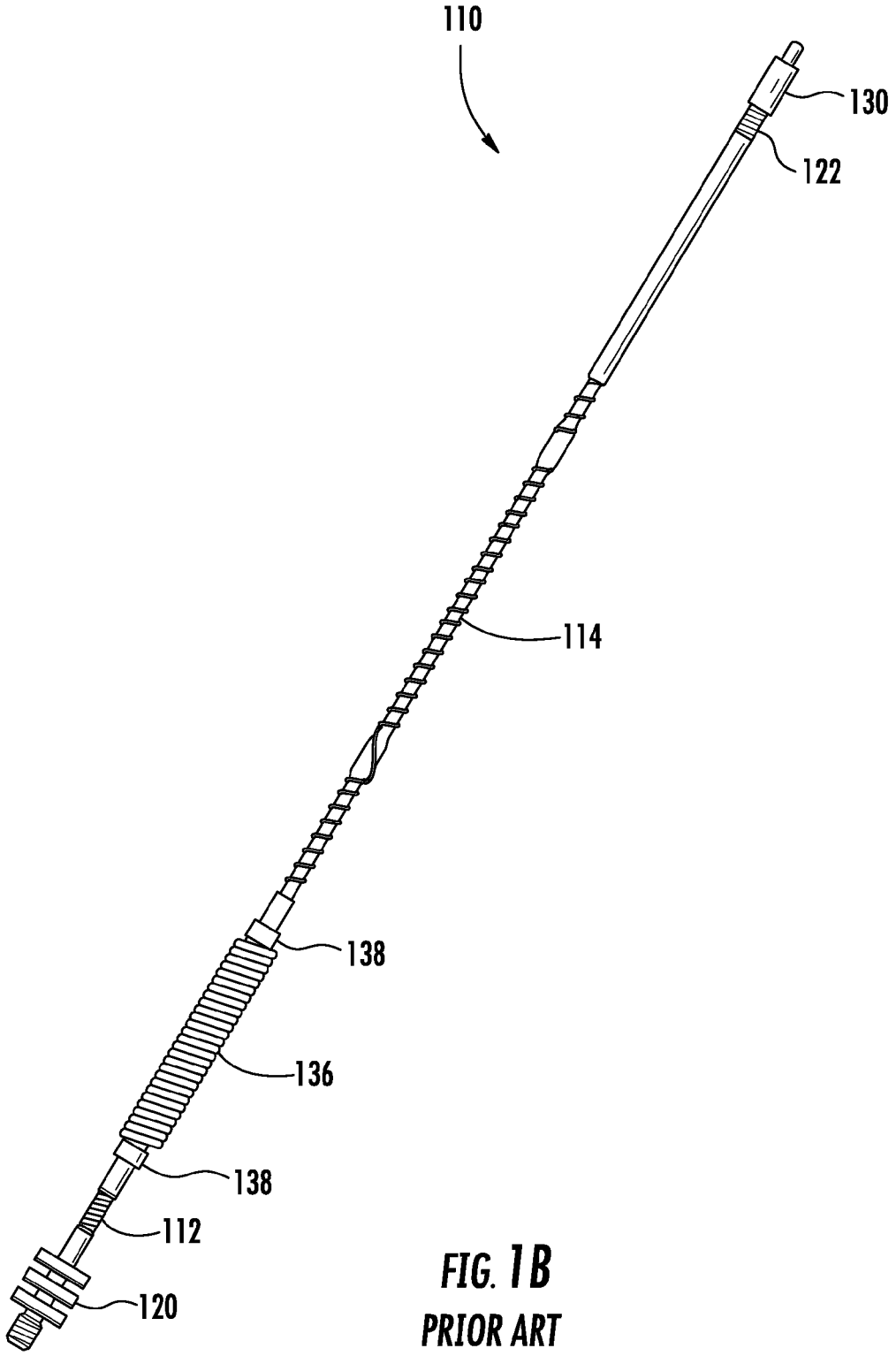
FIG. 1B PRIOR ART
FIG. 1B is a perspective view of another conventional antenna mast assembly.

FIG. 1B illustrates a conventional antenna mast assembly 110 that includes two shafts or rods 112, 114, a connector 120, an upper shrink tube 122, tape 130, a shock spring 136, and ferrules 138. The shaft 114 comprises a relatively inflexible rod. The inventors' hereof have recognized that while the shock spring 136 provides flexibility (e.g., allows flexing or movement of the antenna assembly 110, etc.) and durability for withstanding impact forces (e.g., when striking a parking garage test bar, etc.), the antenna assembly 110 includes a relative high part count, such that it is relatively complex and costly to produce.

After recognizing the above, the inventors hereof have developed and disclose herein exemplary embodiments of antenna mast assemblies that include a single shaft or rod that is made of material(s) (e.g., fiberglass with epoxy resin, polyamide, polyester, other polymers, other synthetic man-made fibers, etc.) more flexible than currently used rods. The use of only one shaft or rod that is made out of more flexible material allows for the number of components to be reduced. In exemplary embodiments, the number of components has been reduced by elimination of the shock spring 136, ferrules 138, a second rod 12, a second coil spring 16, and middle and lower shrink tubes 24, 26. Even with the elimination of the shock spring 136, exemplary embodiments include a single shaft or rod made of flexible enough material that allows the antenna mast assembly to withstand customer requirements while reducing the part count. In addition, this may also allow for reduced labor costs, reduced individual component costs, and reduced overall manufacturing costs. By way of example only, exemplary embodiments disclosed herein may be able to satisfy customer requirements that include the ability to bend around a 300 millimeter cylinder for 24 hours and return to within 5° of original shape; bend to 35° for 2 hours and return to original shape, bend to 35° for 24 hours and return to within 5° of original shape, bend so highest point is under 100 millimeters for 24 hours then return to 100% of original shape, and 1500 hits (shock stability test) without severe damage (operational) (1 hit per second for 25 minutes).

Figure 2:
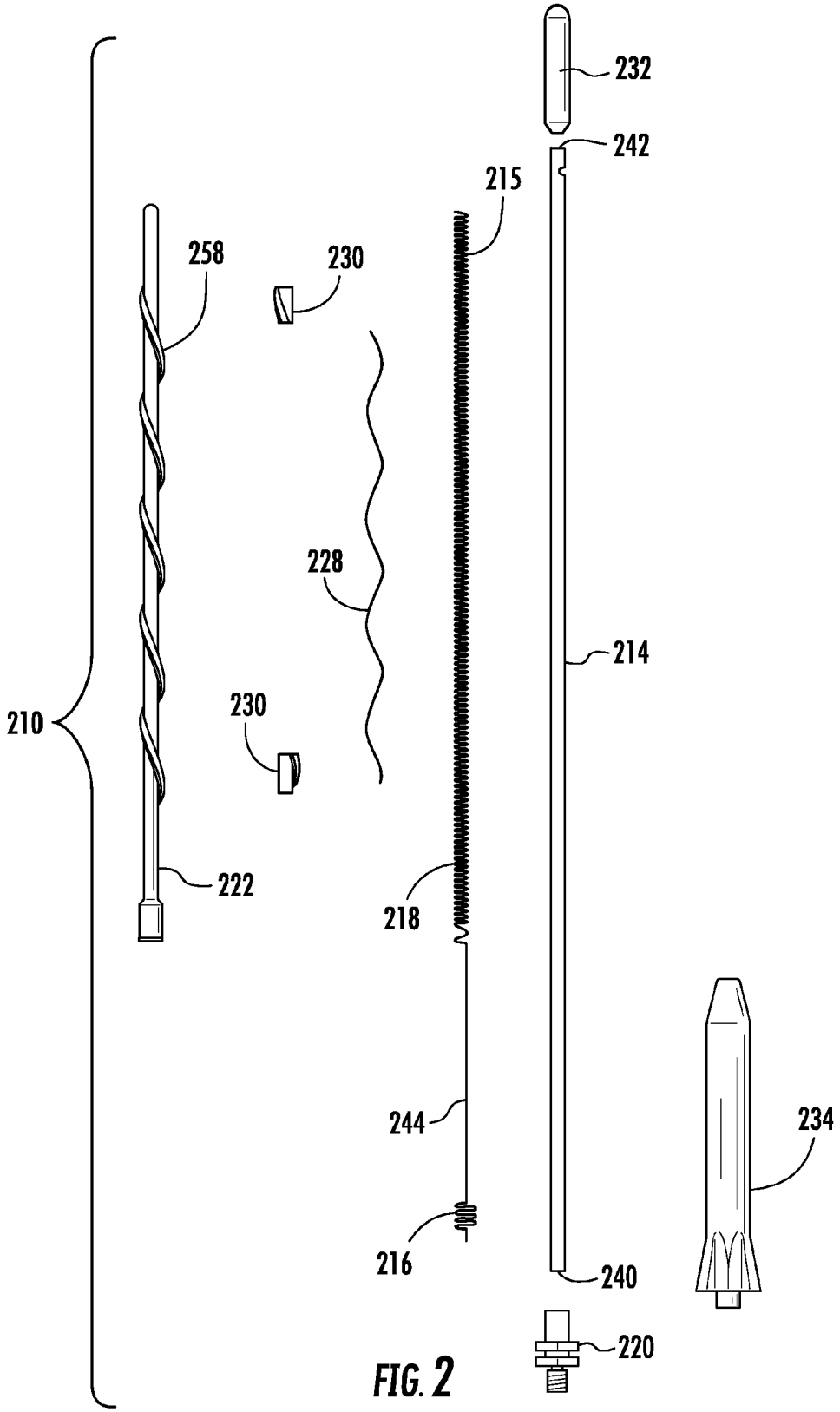
FIG. 2 is a perspective view illustrating various components of an antenna mast assembly according to an exemplary embodiment.
Figure 3:
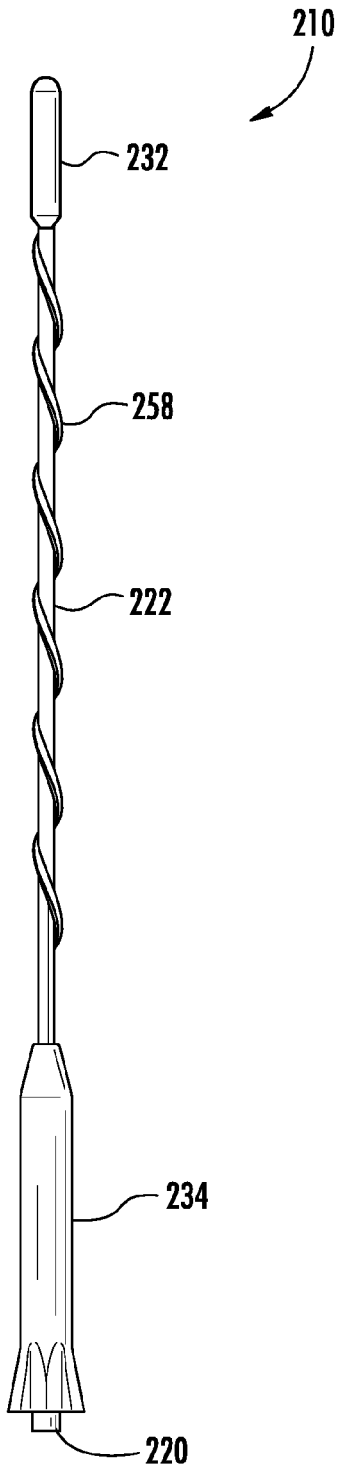
FIG. 3 is a perspective view of the antenna mast assembly shown in FIG. 2 after the components have been assembled.

FIGS. 2 and 3 illustrate an exemplary embodiment of an antenna mast assembly 210 embodying one or more aspects of the present disclosure. As shown in FIG. 2, the antenna mast assembly 210 includes a rod or shaft 214 with a proximal or first end portion 240 and a distal or second end portion 242. The antenna mast assembly 210 also includes a coil or helical radiator 215 configured to be disposed about (e.g., encircle, coiled, wound, etc.) at least a portion of the rod 214, whereby the coil radiator 215 is supported on or by the rod 214. Accordingly, the rod 214 is operable as a support, support structure, or mount for the coil radiator 215, and may thus also be broadly referred to as such.

The rod 214 has a generally circular cross-sectional shape or profile in this exemplary embodiment. In addition, the rod 214 is preferably made of material(s) (e.g., as fiberglass with epoxy resin, polyamide, polyester, other polymers, other synthetic man-made fibers, etc.) more flexible than currently used rods. As shown, the antenna mast assembly 210 includes the single shaft or rod 214. Using only one shaft or rod 214 that is made out of flexible material allows for the number of components to be reduced. Even though this exemplary embodiment does not include a shock spring, the single shaft 214 made of flexible enough material allows the antenna mast assembly 210 to withstand customer requirements such as those mentioned above, while reducing the part count. In addition, this may also allow for reduced labor costs, reduced individual component costs, and reduced overall manufacturing costs.

By way further example, the rod 214 may have a length or height of 267 millimeters, while the antenna assembly 210 (FIG. 3) has an overall height or length of 280 millimeters. These specific dimensions (as are all dimensions herein) are only examples as other exemplary embodiments may be configured with different dimensions such as a greater or shorter length.

The rod 214 is aligned with and/or disposed at least partially along a central longitudinal axis or centerline of the coils of the helical radiator 215. Alternative embodiments may include a rod having a different configuration (e.g., oval shaped cross-section, non-circular cross-section, made of different materials, etc.).

The coil radiator 215 includes a first or lower coil portion 216 and a second or upper coil portion 218. The second coil portion 218 is spaced apart or distanced from the first coil portion 216. The first and second coil portions 216, 218 are configured to be disposed about the rod 214. As shown in FIG. 2, the upper coil portion 218 has a different configuration (e.g., different coil pitch, different length, different number of coils, configured to be resonant in a different frequency band, etc.) than the lower coil portion 216.

For example, one of the upper and lower coil portions 216, 218 may be configured to be operable over and resonant in one or more cellular frequency bands (e.g., LTE 700 MHz, AMPS, GSM850, GSM900, and/or DAB VHF III, etc.), while the other one of the upper and lower coil portions 216, 218 may be configured to be operable over and resonant in the AM and/or FM frequency bands. In this illustrated embodiment, the upper coil portion 218 has a wider coil pitch, has more coils, and is longer than the lower coil portion 216. The upper coil portion 218 may be configured to be resonant (e.g., at about 97 Megahertz (MHz), etc.) in one or more frequency bands (e.g., AM and/or FM frequency bands, etc.) lower than the one or more frequency bands (e.g., one or more cellular frequency bands, etc.) in which the lower coil portion 216 is resonant (e.g., about 698 MHz to about 960 MHz, etc.). By way of example, the lower coil portion 216 may be configured to be operable over and/or resonant in one or more cellular frequency bands (e.g., LTE 700 MHz, AMPS, GSM850, GSM900, and/or DAB VHF III, etc.), while the upper coil portion 218 may be configured to be operable over and/or resonant in the AM and FM frequency bands. In operation, the lower coil portion 216 may also be operable as a choke coil to block cellular phone frequencies and make the lower portion of the antenna structure resonant at about 698 MHz to about 960 MHz, etc.

The coil radiator 215 also includes a linear or straight portion extending between and connecting the first and second coil portions 216, 218. In this exemplary embodiment, the first and second coil portions 216, 218 and the linear connecting portion 244 are part of the single, integrated coil 215. In addition, the coil radiator 215 is configured to be operable over and cover multiple frequency bands which has previously been accomplished using two separate coils 16, 18 shown in FIG. 1A.

With continued reference to FIG. 2, the antenna mast assembly 210 also includes a heat shrinkable or heat shrink tube 222 (broadly, a cover, housing, or radome). As shown in FIG. 3, the tube 222 covers the rod 214 and coil radiator 215 in the final assembled form of the antenna assembly 210.

A spiral straking 228 may be attached to an outer surface of the rod 214 via adhesive tape 230 (see FIG. 2). The spiral straking 228 may generally spiral about or encircle the rod 214 along a length of the rod 214.

The tube 222 may be positioned over the rod 214 and spiral straking 228. Heat may then be applied to cause the tube 222 to shrink about the rod 214 and straking 228, to thereby couple the tube 222 with the rod 214 and straking 228. The tube 222 includes a spiral element 258 (e.g., raised straking, etc.) corresponding to the straking 228. The spiral element 258 generally spirals or encircles around the tube 222 along a length of the tube 222. The spiral element 258 protrudes, extends, etc. outwardly a distance (e.g., a strake, etc.) from the tube 222. The spiral element 258 may function to provide the antenna mast assembly 210 with an asymmetrical cross-sectional area, in forming flutes around the tube 222. The asymmetrical cross-sectional area may function to cause airflow across the tube 222 to generate a significant degree of turbulence for reducing the whistling sound generated by the airflow. The spiral element 258 and base 234 may be configured similarly to a respective spiral element and base disclosed in U.S. Pat. No. 7,671,812, the entire contents of which are incorporated herein by reference.

In the final assembled form shown in FIG. 3, the tube 222 having the raised straking 258 comprise a portion of the exterior of the antenna mast assembly 210, along with a cap 232 and overmold or base 234. The cap 232 and base 234 are respectively located at the top and bottom of the antenna mast assembly 210 with the tube 222 extending therebetween. The cap 232 is coupled to the shrink tube 222 at the second or distal end portion 242 of the rod 214. The base 234 is coupled to the shrink tube 222 and covers the first or proximal end portion 240 of the rod 214. The base 234 additionally covers the portions of the rod 214 and coil radiator 215 not covered by the shrink tube 222.

The antenna mast assembly 210 further includes a connector 220 coupled to the first or proximal end portion 240 of the rod 214. The connector 220 (e.g., threaded shaft, etc.) is used for connecting the antenna mast assembly 210 to a base antenna, which, in turn, is connected (e.g., to one or more electronic devices (e.g., a radio receiver, a touchscreen display, GPS navigation device, cellular phone, etc.) inside the passenger compartment of a vehicle, such that the antenna mast assembly 210 is operable for transmitting and/or receiving signals to/from the electronic device(s) inside the vehicle.

Figure 4:
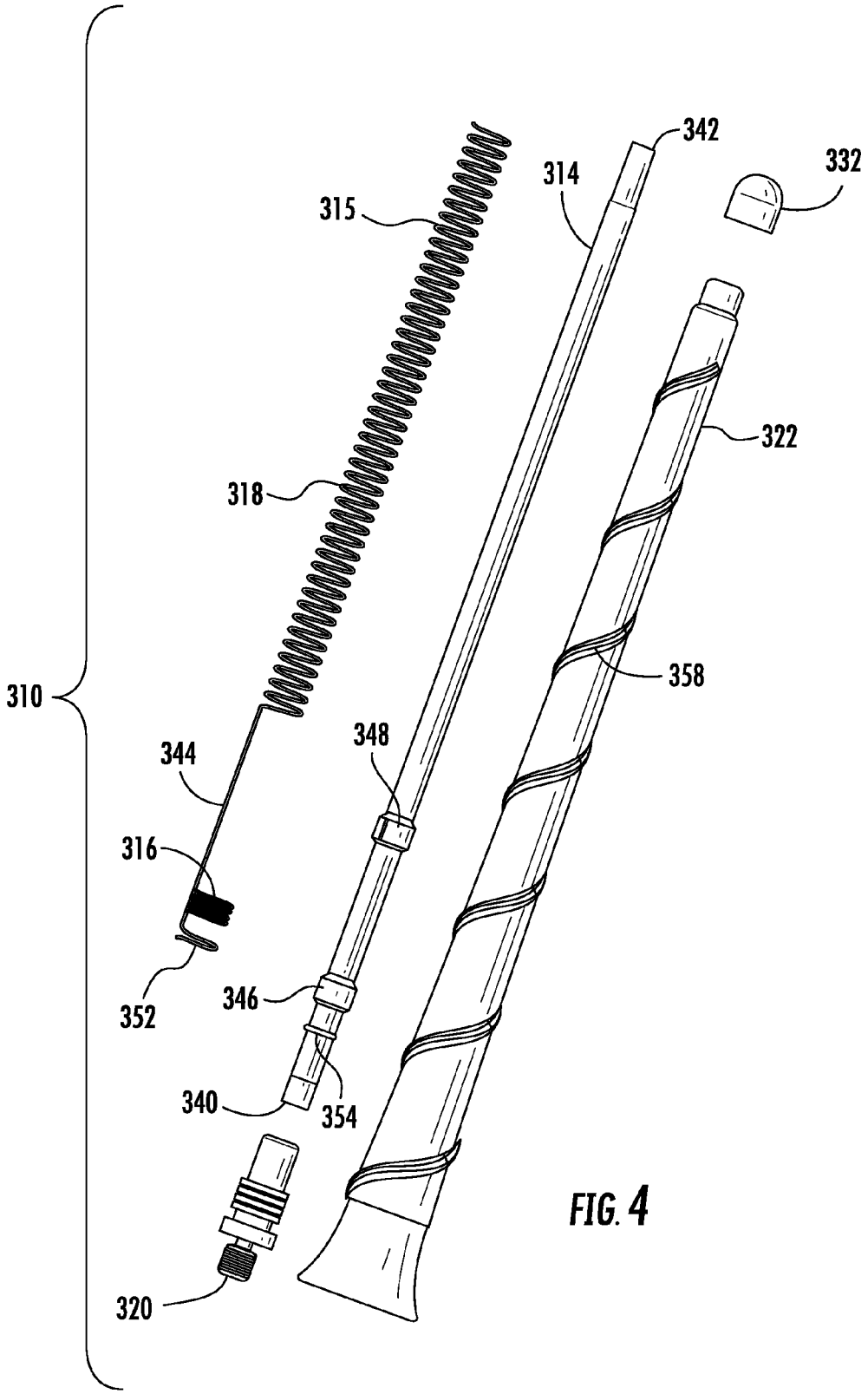
FIG. 4 is a perspective view illustrating various components of a an antenna mast assembly according to another exemplary embodiment.
Figure 5:
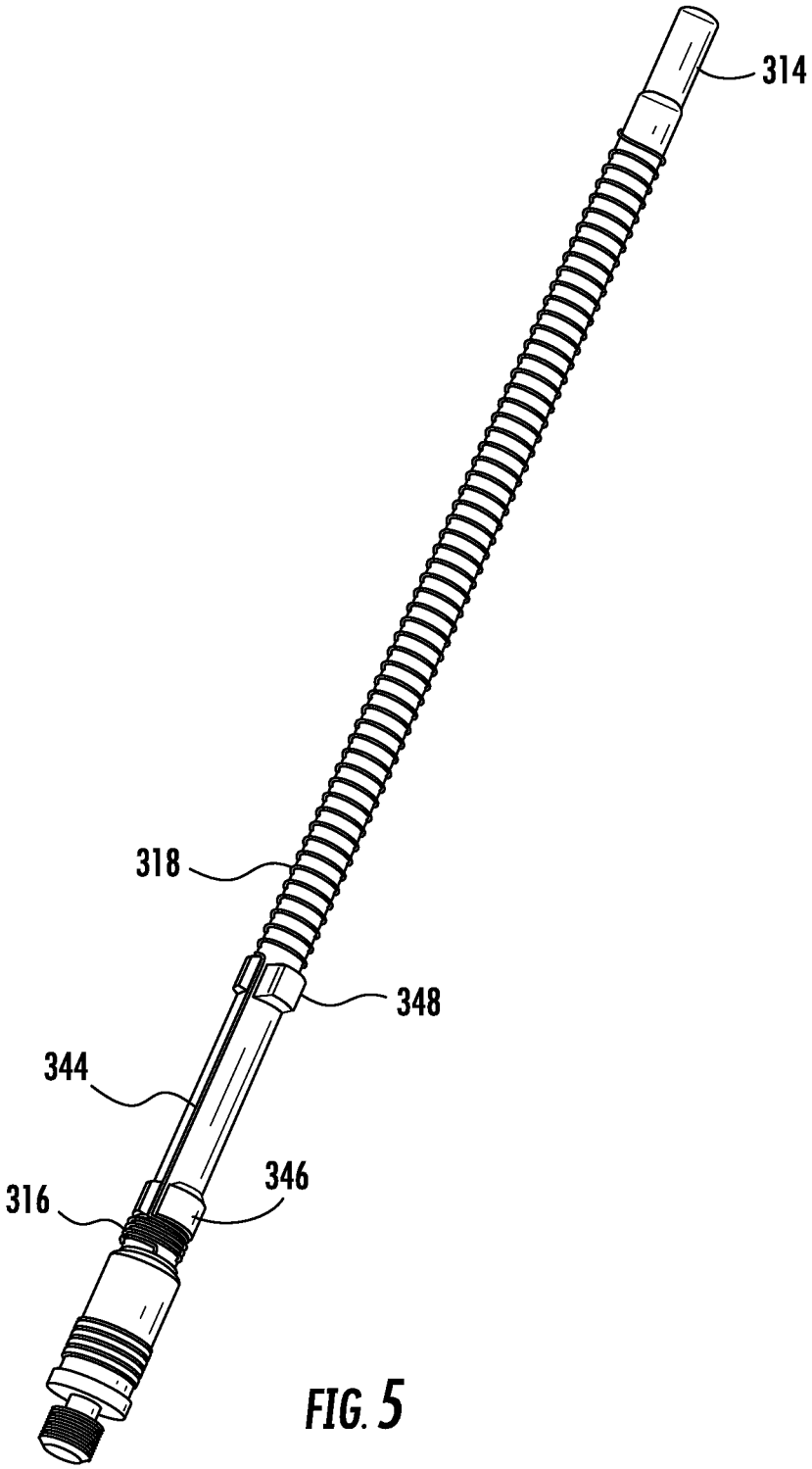
FIG. 5 is a perspective view illustrating various components of the antenna mast assembly shown in FIG. 4 after being assembled together.
Figure 6:
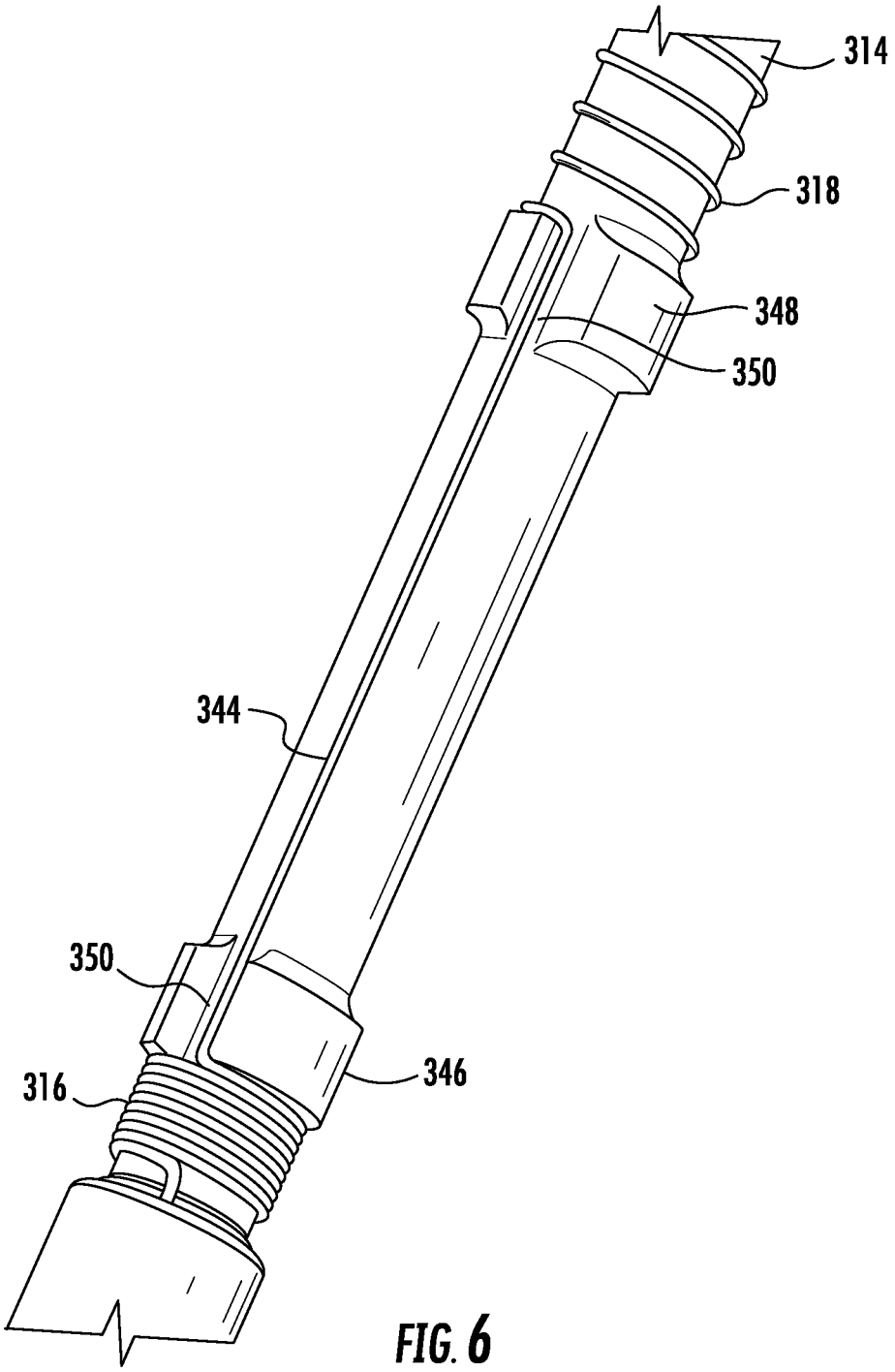
FIG. 6 is an enlarged perspective view of a portion of the antenna mast assembly shown in FIG. 4.

FIGS. 4, 5, and 6 illustrates another exemplary embodiment of an antenna mast assembly 310 embodying one or more aspects of the present disclosure. As shown in FIG. 4, the antenna mast assembly 310 includes a rod or shaft 314 with a proximal or first end portion 340 and a distal or second end portion 342. The antenna mast assembly 310 also includes a coil or helical radiator 315 configured to be disposed about (e.g., encircle, coiled, wound, etc.) at least a portion of the rod 314, whereby the coil radiator 315 is supported on or by the rod 314. Accordingly, the rod 314 is operable as a support, support structure, or mount for the coil radiator 315, and may thus also be broadly referred to as such.

The rod 314 has a generally circular cross-sectional shape or profile in this exemplary embodiment. In addition, the rod 314 may be made out of relatively flexible material, such as fiberglass with epoxy resin, polyamide, polyester, other polymers, other synthetic man-made fibers, etc. Alternative embodiments may include a rod having a different configuration (e.g., oval shaped cross-section, non-circular cross-section, made of different materials, etc.).

The coil radiator 315 includes a first or lower coil portion 316 and an upper or second coil portion 318. The second coil portion 318 is spaced apart or distanced from the first coil portion 316. The first and second coil portions 316, 318 are configured to be disposed (e.g., encircle, coiled, wound, etc.) about the rod 314. The upper coil portion 318 has a different configuration (e.g., different coil pitch, different length, different number of coils, configured to be resonant in a different frequency band, etc.) than the lower coil portion 316.

For example, one of the upper and lower coil portions 316, 318 may be configured to be operable in one or more cellular frequency bands (e.g., LTE 700 MHz, AMPS, GSM850, GSM900, and/or DAB VHF III, etc.), while the other one of the upper and lower coil portions 316, 318 may be configured to be operable over and resonant in the AM and/or FM frequency bands. In this illustrated embodiment, the upper coil portion 318 has a wider coil pitch, has more coils, and is longer than the lower coil portion 316. The upper coil portion 318 may thus be configured to be resonant in a different frequency band than the lower coil portion 316. For example, the upper coil portion 318 may be configured to be resonant (e.g., at about 97 MHz, etc.) in one or more frequency bands (e.g., AM and/or FM frequency bands, etc.) lower than the one or more bands (e.g., one or more cellular frequency bands, etc.) in which the lower coil portion 316 is resonant (e.g., about 698 MHz to about 960 MHz, etc.). By way of example, the lower coil portion 316 may be configured to be operable over and/or resonant in one or more cellular frequency bands (e.g., LTE 700 MHz, AMPS, GSM850, GSM900, and/or DAB VHF III, etc.), while the upper coil portion 318 may be configured to be operable over and/or resonant in the AM and FM frequency bands. In operation, the lower coil portion 316 may also be operable as a choke coil to block cellular phone frequencies and make the lower portion of the antenna structure resonant at about 698 MHz to about 960 MHz, etc. Accordingly, the single coil radiator 315 may be configured to be operable over and cover multiple frequency bands which has previously been accomplished by using two separate coils 16, 18 shown in FIG. 1A.

The coil radiator 315 also includes a linear or straight portion extending between and connecting the first and second coil portions 316, 318. The first and second coil portions 316, 318 and the linear connecting portion 344 are thus part of the single, integrated coil radiator 315.

With continued reference to FIGS. 4 through 6, the rod 314 includes a first or lower protruding portion, step, or shoulder 346 and a second or upper protruding portion, step, or shoulder 348. The first and second steps 346, 348 are spaced apart from each other. As shown in FIGS. 5 and 6, the lower coil portion 316 is supported on the rod 314 between the first step 346 and the first end portion 340 of the rod 314, e.g., the top coil of the lower coil portion 316 sits atop, rests on, or abuts the first step 346. The first step 346 inhibits the lower coil portion 316 from slidably moving above the first step 346 towards the distal or second end portion 342 of the rod 314. The upper coil portion 318 is supported on the rod 314 between the second step 348 and the second end portion 342 of the rod 314, e.g., the bottom coil of the upper coil portion 318 sits atop, rests on, or abuts the second step 348. The second step 348 inhibits the upper coil portion 318 from slidably moving down below the second step 348. Accordingly, the first and second steps 346, 348 cooperatively inhibit or prevent sliding movement of the coil radiator 315 up or down along the rod 314.

As shown in FIG. 6, each step 346, 348 includes an opening, groove, or slot 350 that allows the linear portion 344 to pass therethrough. The positioning of the linear portion 344 with the slots 350 also inhibits the coil radiator 315 from rotating relative to the rod 314.

The coil radiator 315 also includes a bottom portion, coil, or loop 352. The bottom coil 352 may be disposed around the rod 314 so that it abuts against a rib or protruding portion 354 on the rod 314. In addition to helping inhibit relative movement between the coil radiator 315 and rod 314, the step features may help with alignment of the coil radiator 315 and/or enable the coil radiator 315 to be wound by machine about the rod 314. For example, a winding machine may draw wire or other material tightly about the rod 314 during the winding of the coil radiator 315 about the rod 314. Without the step features to stop the coils from slidably moving along the rod 314 and to maintain the linear portion 344 in position, the coils of the upper and/or lower coil portions 316, 318 may loosen during or after winding with the winding machine. Thus, the step features help to solve the coil loosening issue and provide the feasibility to wind the coil radiator 315 about the rod 314 in an automated process with a machine.

With continued reference to FIG. 4, the antenna mast assembly 310 also includes a sheath or cover 322. The sheath 322 may be formed of various materials, such as rubber, etc. In this exemplary embodiment, the sheath 322 includes a spiral element 358 (e.g., spirally projected strake, etc.) on its outer surface. The strake 358 is monolithically or integrally formed with the sheath 322 as an integrated, single component. The sheath 322 may be positioned over the rod 314. Adhesive (e.g., tape or other adhesive bond, etc.) may be used to couple the sheath 322 with the rod 314.

The sheath 322 fully covers the rod 314 and the coil radiator 315 such that the antenna assembly 310 does not necessarily need or require an overmolded base. Accordingly, this exemplary embodiment may allow for a reduced part count (e.g., by eliminating the straking 28 and base 34 shown in FIG. 1A, etc.), which, in turn, may simplify the manufacturing process and allow reduction in manufacturing cost.

The spiral element 358 generally spirals or encircles around the sheath 322 along a length of the sheath 322. The spiral element 358 protrudes, extends, etc. outwardly a distance (e.g., a strake, etc.) from the sheath 322. The spiral element 358 may function to provide the antenna mast assembly 310 with an asymmetrical cross-sectional area, in forming flutes around the sheath 322. The asymmetrical cross-sectional area may function to cause airflow across the sheath 322 to generate a significant degree of turbulence for reducing the whistling sound generated by the airflow. The spiral element 358 may be configured similarly to a spiral element disclosed in U.S. Pat. No. 7,671,812, the entire contents of which are incorporated herein by reference.

In the final assembled form, the sheath 322 having the raised straking 358 comprises a portion of the exterior of the antenna mast assembly 310, along with a cap 332. The cap 332 is coupled at the top of the sheath 322.

The antenna mast assembly 310 further includes a connector 320 coupled to the first or proximal end portion 340 of the rod 314. The connector 320 (e.g., coaxial connector etc.) is used for connecting the antenna assembly 310 to a communication link or line (e.g., coaxial cable, etc.), which, in turn, is connected to one or more electronic devices (e.g., a radio receiver, a touchscreen display, GPS navigation device, cellular phone, etc.) inside the passenger compartment of a vehicle, such that the antenna mast assembly 310 is operable for transmitting and/or receiving signals to/from the electronic device(s) inside the vehicle.

In exemplary embodiments of an antenna mast assembly, the support, support structure, or mount (e.g., rod or shaft, etc.) for the coil radiator may be configured so as to increase flexibility of the mast, whereby the increased flexibility may help the antenna mast assembly survive bend tests and/or improve the bend test results. In such embodiments, an additional structure or material is provided within or introduced into the rod, shaft, or other support for the coil radiator. The additional structure or material helps increase the bending strength of the mast, thereby resulting in better spring back of the mast after a prolonged bending. By way of example, this may be accomplished by overmolding the rod or shaft (e.g., rod or shaft 314 (FIG. 4), etc.) over the new structure or material, which material is preferably spring steel or other highly flexible material, etc. In some embodiments in which the additional structure or material is electrically-conductive (e.g., spring steel, etc.), it may be used as an additional radiator, e.g., for DAB frequencies, etc. The additional structure or material may be provided in various configurations, such as a hollow or tubular elongate member (e.g., a rod 460 (FIG. 7), etc.), a coil configuration (e.g., coil 560 (FIG. 8), etc.), among other possible configurations.

Figure 7:
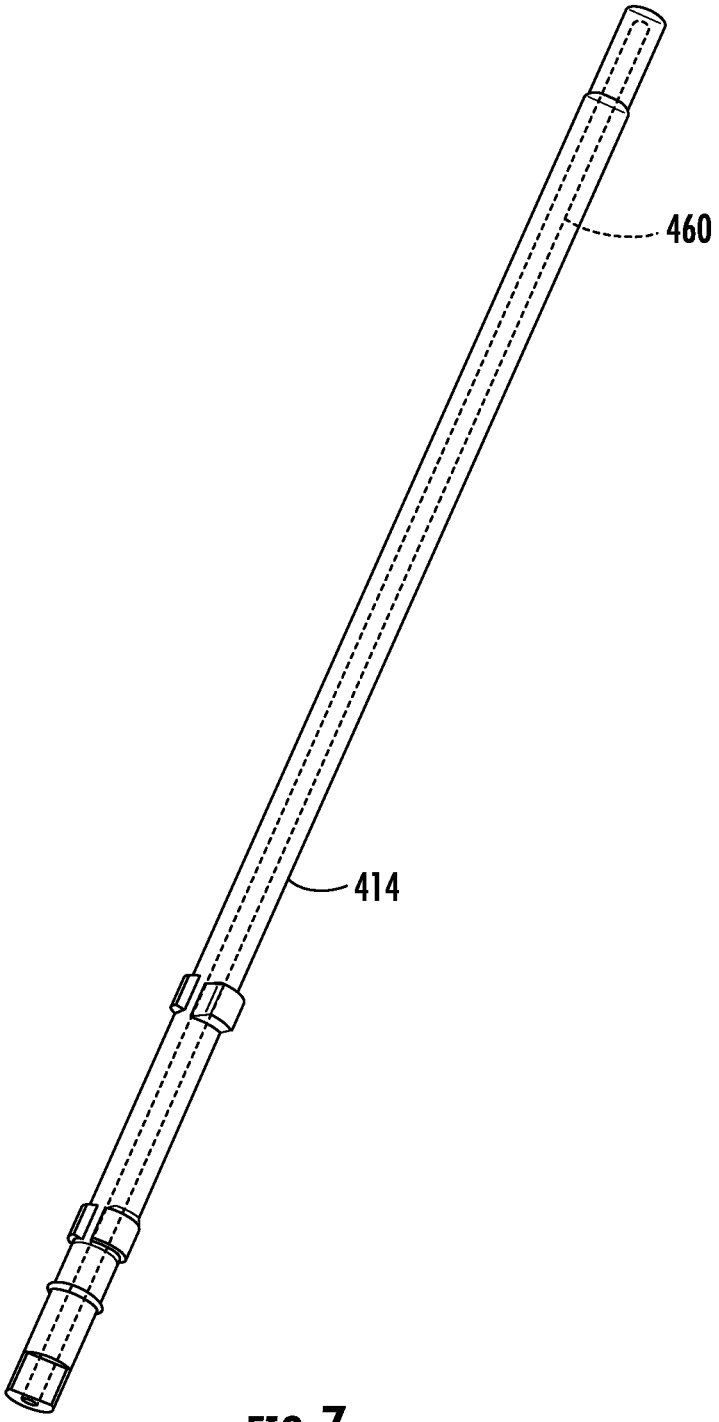
FIG. 7 is a perspective view of a support for a coil radiator, where the support is overmolded onto a hollow or tubular rod according to an exemplary embodiment.

FIG. 7 illustrates an exemplary embodiment of a support, support structure, or mount 414 for a coil radiator embodying one or more aspects of the present disclosure. In this exemplary embodiment, a hollow or tubular rod 460 is internal to or within the support 414. The inner rod 460 is preferably spring steel or other highly flexible material over which the support 414 is overmolded. In operation, the inner rod 460 may help increase the bending strength of the mast, thereby resulting in better spring back of the mast after a prolonged bending. In this example, the support 414 may be identical or substantially similar to the rod 314 and/or may be used for supporting a coil radiator, such as coil radiator 315 (FIG. 4), etc.

Figure 8:
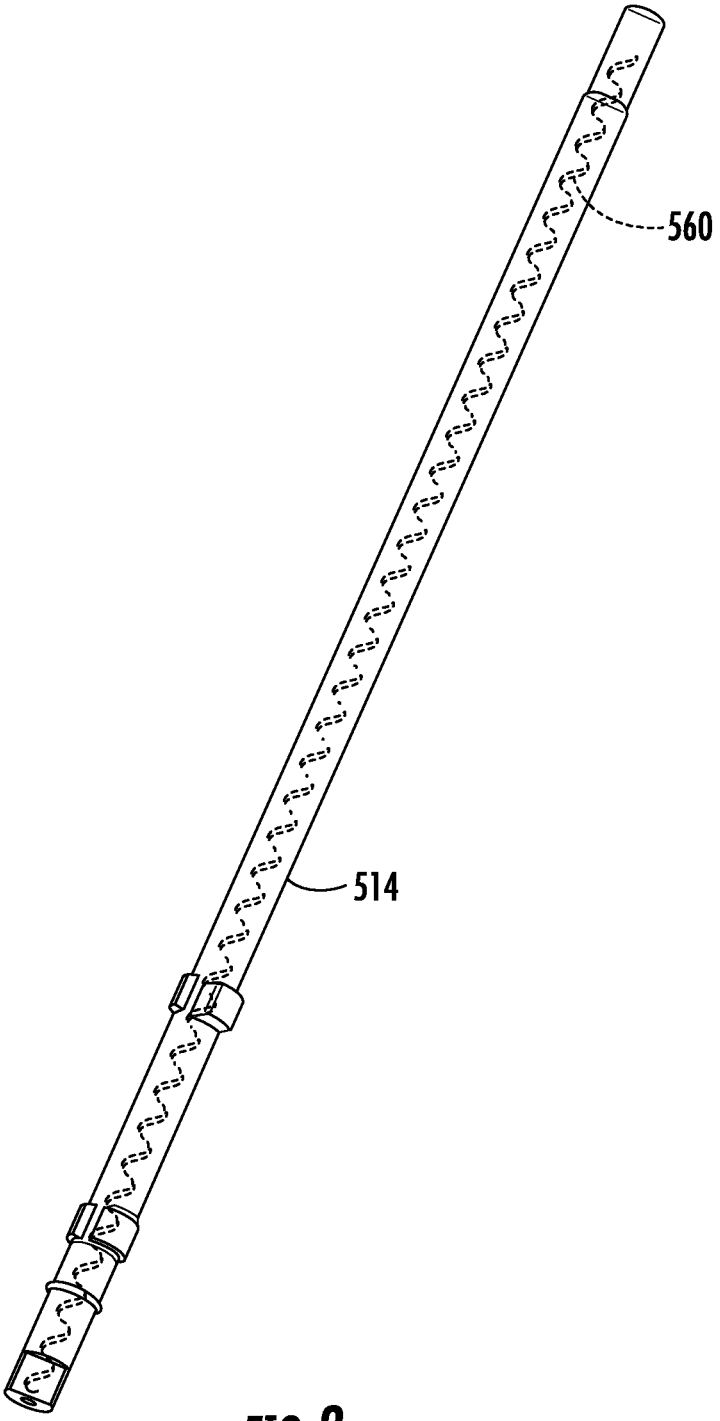
FIG. 8 is a perspective view of a support for a coil radiator, where the support is overmolded onto a coil according to another exemplary embodiment.

FIG. 8 illustrates an exemplary embodiment of a support, support structure, or mount 514 for a coil radiator embodying one or more aspects of the present disclosure. In this exemplary embodiment, a coil 560 is internal to or within the support 514. The coil 560 is preferably spring steel or other highly flexible material over which the support 514 is overmolded. In operation, the inner coil 560 may help increase the bending strength of the mast, thereby resulting in better spring back of the mast after a prolonged bending. In this example, the support 514 may be identical or substantially similar to the rod 514 and/or may be used for supporting a coil radiator, such as coil radiator 315 (FIG. 4), etc.

Exemplary embodiments of an antenna mast assembly (e.g., 210, 310, etc.) disclosed herein may be used in combination with a wide range of antenna base assemblies, such that the combination of the antenna base and mast assemblies provide multiband operation over multiple operating frequencies, e.g., operable and resonant in six or more frequency bands, etc. By way of example, an antenna mast assembly may be installed or mounted to a hood of a vehicle, while the antenna base assembly may be installed or mounted to the vehicle's roof. The antenna mast assembly may be configured to be operable over and cover multiple frequency ranges or bands, such one or more or any combination of the following frequency bands: amplitude modulation (AM), frequency modulation (FM), and one or more cellular frequency bands (e.g., LTE 700 MHz, AMPS, GSM850, GSM900, and/or DAB VHF III, etc.). The antenna base assembly may be configured to be operable over and cover multiple frequency ranges or bands, such that the combination of the antenna mast and antenna base assembly is operable over and covers at least the following frequency ranges or bands: AM, FM, global positioning system (GPS), satellite digital audio radio services (SDARS) (e.g., Sirius XM, etc.), Glonass, LTE700, AMPS, GSM850, GSM900, PCS, GSM1800, GSM1900, AWS, and UMTS.

An exemplary embodiment of an antenna mast assembly disclosed herein may be used in combination with an multiband multiple input multiple output (MIMO) antenna assembly disclosed in U.S. Provisional Patent Application 61/570,534. By way of further example, an exemplary embodiment of an antenna mast assembly disclosed herein may be used in combination with an antenna assembly disclosed in PCT International Patent Publication No. WO 2012/044968. The entire contents of the above patent application and publication are incorporated herein by reference.

The combination of the antenna mast and antenna base assemblies may be configured to be operable within at least the following frequency bandwidths associated with cellular communications, such as one or more (or all) of AMPS/GSM850, GSM900, GSM1800, PCS/GSM1900, UMTS/AWS, GSM850, GSM1900, AWS, LTE (e.g., 4G, 3G, other LTE generation, B17 (LTE), LTE (700 MHz), etc.), AMPS, PCS, EBS (Educational Broadband Services), BRS (Broadband Radio Services), WCS (Broadband Wireless Communication Services/Internet Services), cellular frequency bandwidth(s) associated with or unique to a particular one or more geographic regions or countries, one or more frequency bandwidth(s) from Table 1 and/or Table 2 below, etc.

TABLE 1

| System/Band Description | Upper Frequency (MHz) | Lower Frequency (MHz) |
|---|---|---|
| 700 MHz Band | 698 | 862 |
| B17 (LTE) | 704 | 787 |
| AMPS/GSM850 | 824 | 894 |
| GSM 900 (E-GSM) | 880 | 960 |
| DCS 1800/GSM1800 | 1710 | 1880 |
| PCS/GSM1900 | 1850 | 1990 |
| W CD MA/UMTS | 1920 | 2170 |
| 2.3 GHz Band IMT Extension | 2300 | 2400 |
| IEEE 802.11B/G | 2400 | 2500 |
| EBS/BRS | 2496 | 2690 |
| W IMAX MMDS | 2500 | 2690 |

TABLE 1-continued

| System/Band Description | Upper Frequency (MHz) | Lower Frequency (MHz) |
|---|---|---|
| BROADBAND RADIO SERVICES/BRS (MMDS) | 2700 | 2900 |
| W IMAX (3.5 GHz) | 3400 | 3600 |
| PUBLIC SAFETY RADIO | 4940 | 4990 |

TABLE 2

| | Tx/Uplink (MHz) | | Rx/Downlink (MHz) | |
|---|---|---|---|---|
| Band | Start | Stop | Start | Stop |
| GSM 850/AMP | 824.00 | 849.00 | 869.00 | 894.00 |
| GSM 900 | 876.00 | 914.80 | 915.40 | 959.80 |
| AWS | 1710.00 | 1755.80 | 2214.00 | 2180.00 |
| GSM 1800 | 1710.20 | 1784.80 | 1805.20 | 1879.80 |
| GSM 1900 | 1850.00 | 1910.00 | 1930.00 | 1990.00 |
| UMTS | 1920.00 | 1980.00 | 2110.00 | 2170.00 |
| LTE | 2010.00 | 2025.00 | 2010.00 | 2025.00 |
| LTE | 2300.00 | 2400.00 | 2300.00 | 2400.00 |
| LTE | 2496.00 | 2690.00 | 2496.00 | 2690.00 |
| LTE | 2545.00 | 2575.00 | 2545.00 | 2575.00 |
| LTE | 2570.00 | 2620.00 | 2570.00 | 2620.00 |

Example embodiments are provided so that this disclosure will be thorough, and will fully convey the scope to those who are skilled in the art. Numerous specific details are set forth such as examples of specific components, devices, and methods, to provide a thorough understanding of embodiments of the present disclosure. It will be apparent to those skilled in the art that specific details need not be employed, that example embodiments may be embodied in many different forms (e.g., different materials may be used, etc.) and that neither should be construed to limit the scope of the disclosure. In some example embodiments, well-known processes, well-known device structures, and well-known technologies are not described in detail. In addition, advantages and improvements that may be achieved with one or more exemplary embodiments of the present disclosure are provided for purpose of illustration only and do not limit the scope of the present disclosure, as exemplary embodiments disclosed herein may provide all or none of the above mentioned advantages and improvements and still fall within the scope of the present disclosure.

Specific dimensions, specific materials, and/or specific shapes disclosed herein are example in nature and do not limit the scope of the present disclosure. The disclosure herein of particular values and particular ranges of values (e.g., frequency ranges, etc.) for given parameters are not exclusive of other values and ranges of values that may be useful in one or more of the examples disclosed herein. Moreover, it is envisioned that any two particular values for a specific parameter stated herein may define the endpoints of a range of values that may be suitable for the given parameter (i.e., the disclosure of a first value and a second value for a given parameter can be interpreted as disclosing that any value between the first and second values could also be employed for the given parameter). Similarly, it is envisioned that disclosure of two or more ranges of values for a parameter (whether such ranges are nested, overlapping or distinct) subsume all possible combination of ranges for the value that might be claimed using endpoints of the disclosed ranges.

The terminology used herein is for the purpose of describing particular example embodiments only and is not intended to be limiting. As used herein, the singular forms "a", "an"

and "the" may be intended to include the plural forms as well, unless the context clearly indicates otherwise. The terms "comprises," "comprising," "including," and "having," are inclusive and therefore specify the presence of stated features, integers, steps, operations, elements, and/or components, but do not preclude the presence or addition of one or more other features, integers, steps, operations, elements, components, and/or groups thereof. The method steps, processes, and operations described herein are not to be construed as necessarily requiring their performance in the particular order discussed or illustrated, unless specifically identified as an order of performance. It is also to be understood that additional or alternative steps may be employed.

When an element or layer is referred to as being "on", "engaged to", "connected to" or "coupled to" another element or layer, it may be directly on, engaged, connected or coupled to the other element or layer, or intervening elements or layers may be present. In contrast, when an element is referred to as being "directly on," "directly engaged to", "directly connected to" or "directly coupled to" another element or layer, there may be no intervening elements or layers present. Other words used to describe the relationship between elements should be interpreted in a like fashion (e.g., "between" versus "directly between," "adjacent" versus "directly adjacent," etc.). As used herein, the term "and/or" includes any and all combinations of one or more of the associated listed items. The term "about" when applied to values indicates that the calculation or the measurement allows some slight imprecision in the value (with some approach to exactness in the value; approximately or reasonably close to the value; nearly). If, for some reason, the imprecision provided by "about" is not otherwise understood in the art with this ordinary meaning, then "about" as used herein indicates at least variations that may arise from ordinary methods of measuring or using such parameters. For example, the terms "generally", "about", and "substantially" may be used herein to mean within manufacturing tolerances.

Although the terms first, second, third, etc. may be used herein to describe various elements, components, regions, layers and/or sections, these elements, components, regions, layers and/or sections should not be limited by these terms. These terms may be only used to distinguish one element, component, region, layer or section from another region, layer or section. Terms such as "first," "second," and other numerical terms when used herein do not imply a sequence or order unless clearly indicated by the context. Thus, a first element, component, region, layer or section discussed below could be termed a second element, component, region, layer or section without departing from the teachings of the example embodiments.

Spatially relative terms, such as "inner," "outer," "beneath", "below", "lower", "above", "upper" and the like, may be used herein for ease of description to describe one element or feature's relationship to another element(s) or feature(s) as illustrated in the figures. Spatially relative terms may be intended to encompass different orientations of the device in use or operation in addition to the orientation depicted in the figures. For example, if the device in the figures is turned over, elements described as "below" or "beneath" other elements or features would then be oriented "above" the other elements or features. Thus, the example term "below" can encompass both an orientation of above and below. The device may be otherwise oriented (rotated 90 degrees or at other orientations) and the spatially relative descriptors used herein interpreted accordingly.

The foregoing description of the embodiments has been provided for purposes of illustration and description. It is not intended to be exhaustive or to limit the disclosure. Individual elements, intended or stated uses, or features of a particular embodiment are generally not limited to that particular embodiment, but, where applicable, are interchangeable and can be used in a selected embodiment, even if not specifically shown or described. The same may also be varied in many ways. Such variations are not to be regarded as a departure from the disclosure, and all such modifications are intended to be included within the scope of the disclosure.

What is claimed is:

1. An antenna mast assembly comprising:

a coil radiator including a first coil portion and a second coil portion;

a support for the coil radiator, the support comprising a rod having a first end portion, a second end portion, a first protruding portion, and a second protruding portion;

wherein the coil radiator is disposed about at least a portion of the rod such that the first coil portion is supported on the rod between the first protruding portion and the first end portion of the rod, and such that the second coil portion is supported on the rod between the second protruding portion and the second end portion of the rod, whereby the first and second protruding portions are operable for inhibiting sliding movement of the coil radiator along the rod.

2. The antenna mast assembly of claim 1, wherein the first coil portion has a different configuration than the second coil portion such that the first coil portion is operable over or resonant in one or more frequency bands different than the second coil portion.

3. The antenna mast assembly of claim 1, wherein:

the second coil portion has a wider coil pitch than the first coil portion; and/or the second coil portion has more coils than the first coil portion; and/or the second coil portion is longer than the first coil portion.

4. The antenna mast assembly of claim 1, wherein the antenna mast assembly includes only the one said coil radiator which is configured to be operable within multiple frequency bands including an amplitude modulation (AM) band, a frequency modulation (FM) band, and one or more cellular frequency bands, whereby the antenna mast assembly is operable within the multiple frequency bands without requiring any additional coil radiators.

5. The antenna mast assembly of claim 1, wherein:

one of the first and second coil portions is configured to be operable over or resonant in the AM and FM frequency bands; and the other one of the first and second coil portions is configured to be operable over or resonant in one or more cellular frequency bands.

6. The antenna mast assembly of claim 5, wherein the one or more cellular frequency bands comprise one or more of LTE 700 MHz, AMPS, GSM850, GSM900, and/or DAB VHF III.

7. An antenna mast assembly of claim 1 for use with an automobile, wherein the rod comprises a flexible rod and the coil radiator is disposed about at least a portion of the flexible rod, wherein the flexible rod comprises fiberglass with epoxy resin, polyamide, and/or polyester.

8. An antenna mast assembly comprising:

a coil radiator including a first coil portion and a second coil portion;

a support for the coil radiator;

wherein:

the support comprises a rod having a first end portion, a second end portion, a first protruding portion, and a second protruding portion;

the first protruding portion comprises a first step;

the second protruding portion comprises a second step;

the first coil portion is between the first step and the first end portion of the rod, whereby contact of the first coil portion with the first step inhibits sliding movement of the first coil portion along the rod in a direction towards the second end portion; and the second coil portion is between the second step and the second end portion of the rod, whereby contact of the second coil portion with the second step inhibits sliding movement of the second coil portion along the rod in a direction towards the first end portion of the rod.

9. An antenna mast assembly comprising:

a coil radiator including a first coil portion and a second coil portion;

a support for the coil radiator, the support having a first end portion, a second end portion, a first protruding portion, and a second protruding portion;

wherein the coil radiator is disposed about at least a portion of the support such that the first coil portion is between the first protruding portion and the first end portion of the support, and such that the second coil portion is between the second protruding portion and the second end portion of the support;

whereby the first and second protruding portions are operable for inhibiting sliding movement of the coil radiator relative to the support;

wherein:

the first coil portion is spaced apart from the second coil portion; and the coil radiator includes a linear portion extending between and connecting the first and second coil portions.

10. The antenna mast assembly of claim 9, wherein:

the support comprises a rod;

the first coil portion is supported on the rod between the first protruding portion and the first end portion of the rod; and the second coil portion is supported on the rod between the second protruding portion and the second end portion of the rod;

whereby the first and second protruding portions are operable for inhibiting sliding movement of the coil radiator along the rod.

11. The antenna mast assembly of claim 9, wherein:

the first and second protruding portions include openings; and the linear portion passes through the openings.

12. The antenna mast assembly of claim 11, wherein the positioning of the linear portion within the openings of the first and second protruding portions inhibits the coil radiator from rotating relative to the support.

13. The antenna mast assembly of claim 9, wherein the upper coil portion, the lower coil portion, and the linear portion are an integrated, single component.

14. An antenna mast assembly of claim 9 for use with an automobile, wherein the first coil portion has a different configuration than the second coil portion such that the first coil portion is operable over or resonant in one or more frequency bands different than the second coil portion and such that the coil radiator is operable over or resonant in multiple frequency bands including an amplitude modulation (AM) band, a frequency modulation (FM) band, and one or more cellular frequency bands.

15. The antenna mast assembly of claim 14, wherein the antenna mast assembly includes only the one said coil radiator, and the antenna mast assembly is operable within the multiple frequency bands without any additional coil radiators.

16. The antenna mast assembly of claim 14, wherein:

the second coil portion has a wider coil pitch than the first coil portion; and/or the second coil portion has more coils than the first coil portion; and/or the second coil portion is longer than the first coil portion.

17. The antenna mast assembly of claim 14, wherein:

one of the first and second coil portions is configured to be operable over or resonant in the AM and FM frequency bands; and the other one of the first and second coil portions is configured to be operable over or resonant in one or more cellular frequency bands.

18. The antenna mast assembly of claim 17, wherein the one or more cellular frequency bands comprise one or more of LTE 700 MHz, AMPS, GSM850, GSM900, and/or DAB VHF III.

19. The antenna mast assembly of claim 14, wherein the support comprises a rod about which the coil radiator is disposed, and wherein:

the rod comprises fiberglass with epoxy resin, polyamide, and/or polyester; and/or the rod comprises a first step and second step, the first coil portion supported on the rod between the first protruding portion and a first end portion of the rod, the second coil portion supported on the rod between the second protruding portion and a second end portion of the rod, whereby the first and second protruding portions are operable for inhibiting sliding movement of the coil radiator along the rod.

20. The antenna mast assembly of claim 14, wherein the support is overmolded onto a flexible structure, whereby the flexible structure is operable for helping increase bending strength thereby resulting in better spring back after prolonged bending.

21. The antenna mast assembly of claim 20, wherein:

the flexible structure comprises a hollow rod or coil; and/or the flexible structure comprises spring steel.

22. An antenna mast assembly comprising:

a coil radiator including a first coil portion and a second coil portion;

a support for the coil radiator, the support having a first end portion, a second end portion, a first protruding portion, and a second protruding portion;

wherein the coil radiator is disposed about at least a portion of the support such that the first coil portion is between the first protruding portion and the first end portion of the support, and such that the second coil portion is between the second protruding portion and the second end portion of the support;

whereby the first and second protruding portions are operable for inhibiting sliding movement of the coil radiator relative to the support;

wherein the support comprises a rod made of fiberglass with epoxy resin, polyamide, and/or polyester.

23. An antenna mast assembly comprising:

a coil radiator including a first coil portion and a second coil portion;

a support for the coil radiator, the support having a first end portion, a second end portion, a first protruding portion, and a second protruding portion;

wherein the coil radiator is disposed about at least a portion of the support such that the first coil portion is between the first protruding portion and the first end portion of the support, and such that the second coil portion is between the second protruding portion and the second end portion of the support;

whereby the first and second protruding portions are operable for inhibiting sliding movement of the coil radiator relative to the support;

wherein the support is overmolded onto a flexible structure, whereby the flexible structure is operable for helping increase bending strength thereby resulting in better spring back after prolonged bending.

24. The antenna mast assembly of claim 23, wherein:

the flexible structure comprises a hollow rod or coil; and/or the flexible structure comprises spring steel.

* * * * *